US005745023A

United States Patent [19]

Totsuka

[11] Patent Number: 5,745,023

[45] Date of Patent: Apr. 28, 1998

[54] FUSE ELEMENT HAVING LOW MELTING POINT CURVED SURFACE METAL AND CLAMPING PIECES WITH PROJECTIONS

[75] Inventor: Mitsuhiko Totsuka, Shizuoka, Japan

[73] Assignee: Yazaki Corporation, Tokyo, Japan

[21] Appl. No.: 710,513

[22] Filed: Sep. 18, 1996

[30] Foreign Application Priority Data

Oct. 13, 1995 [JP] Japan ..... 7-265672

[51] Int. Cl.[6] ..... H01H 85/04

[52] U.S. Cl. ..... 337/160; 337/260; 337/255

[58] Field of Search ..... 337/152, 160, 337/260, 296, 297, 255

[56] References Cited

U.S. PATENT DOCUMENTS

| | | | |
|---|---|---|---|
| 4,652,848 | 3/1987 | Hundrieser | 337/297 |
| 4,717,902 | 1/1988 | James | 337/32 |
| 4,751,489 | 6/1988 | Spaunhorst | 337/260 |
| 4,798,546 | 1/1989 | Herbert | 439/830 |
| 4,943,248 | 7/1990 | Colleran | 439/850 |
| 4,944,084 | 7/1990 | Horibe | 337/160 |
| 4,984,125 | 1/1991 | Uwano | 361/124 |
| 4,992,770 | 2/1991 | Spalding | 337/164 |
| 5,373,278 | 12/1994 | Saulegot | 337/255 |
| 5,528,213 | 6/1996 | Kondo | 337/160 |
| 5,546,066 | 8/1996 | Kondo | 337/163 |

FOREIGN PATENT DOCUMENTS

A62-1349 1/1987 Japan .

*Primary Examiner*—Leo P. Picard
*Assistant Examiner*—Jayprakash N. Gandhi
*Attorney, Agent, or Firm*—Sughrue, Mion, Zinn, Macpeak & Seas, PLLC

[57] ABSTRACT

A fuse element which includes a substantially beltlike fusible body for electrically connecting a pair of connecting terminal portions to each other, the connecting terminal portions connected to an electric circuit, a low-melting-point metal piece clamped and fixed onto a melting metal adding portion arranged on the fusible body in order to adjust a fusion characteristic of the fusible body, and a pair of clamping pieces formed to extend outward from both side edges of the melting metal adding portion of the fusible body for clamping and fixing the low-melting-point metal piece set on the melting metal adding portion from both sides of the low-melting-point metal piece, in which the pair of clamping pieces have projections for holding the low-melting-point metal piece in press contact with each other by projecting into a space defined by a width of the melting metal adding portion when the clamping pieces are upwardly bent from both sides of the melting metal adding portion.

3 Claims, 6 Drawing Sheets

FUSE ELEMENT HAVING LOW MELTING POINT CURVED SURFACE METAL AND CLAMPING PIECES WITH PROJECTIONS

BACKGROUND OF THE INVENTION

FIELD OF THE INVENTION

The invention relates to a fuse element of a type that a low-melting-point metal piece for adjusting a fusion characteristic of a substantially beltlike fusible body is clamped and fixed onto the fusible body that electrically connects a pair of connecting terminal portions to each other, the pair of connecting terminal portions being connected to an electric circuit.

BACKGROUND

Recently, a fuse element of a type that a fusion characteristic of a fusible body is adjusted by a melting heat of a low-melting-point metal piece, is developed. The low-melting-point metal piece is clamped and fixed onto the fusible body, and the low-melting-point metal piece has a lower melting point than the fusible body, the fusible body fuses when an overcurrent flows therethrough.

In the fuse element, the fusion characteristic of the fusible body can be changed easily by changing the size of the low-melting-point metal piece, that causes a fine adjustment of the fusion characteristic easier and a production control easier by allowing the types of fusible bodies to be reduced compared with the conventional system in which various types of fusible bodies must be fabricated per fusion characteristic.

FIG. 3 shows an example of fuse element in which a low-melting-point metal piece is clamped and fixed onto a fusible body.

A fuse element 1 is designed to be attached to a housing (not shown) as a so-called fusible link, the housing being made of insulating resin. This fuse element 1 is formed by press-forming a metal plate so that a pair of connecting terminal portions 2, 3 and a substantially beltlike fusible body 4 electrically connecting the connecting terminal portions 2, 3 to each other, are integrally formed.

The connecting terminal portions 2, 3 in this example has box-like (female-type) electric contact portions S formed at the ends thereof.

The fusible body 4 is designed so that a melting metal adding portion 6 is arranged close to a fusing portion 5 narrowed to obtain a predetermined fusion characteristic, and further, a pair of clamping pieces 7, 8 are arranged from both side edges of the melting metal adding portion 6 to extend respectively in a width direction of the fusible body 4. A low-melting-point metal piece 9 whose melting point is lower than a melting point of the fusible body 4, the low-melting-point metal piece 9 can be clamped and fixed onto the melting metal adding portion 6 by the pair of clamping pieces 7, 8.

The operation of clamping and fixing the low-melting-point metal piece 9 onto the melting metal adding portion 6 is automated.

A conventional fusible link assembling process in which the low-melting-point metal piece 9 is clamped and fixed by automation will now be described.

As shown in FIG. 4, the fusible body 4 is transferred to a predetermined position in the form of a flat metal blank in which the pair of clamping pieces 7, 8 extend coplanar with the fusible body 4. When the fusible body 4 has been transferred to the predetermined position, the low-melting-point metal piece 9 is placed on the melting metal adding portion 6 as shown in FIG. 5. Then, the low-melting-point metal piece 9 is kept intact on the melting metal adding portion 6, and is pressed and fixed by pressing onto the fusible body 4 by a pressing tool 10 that is arranged above the melting metal adding portion 6 so as to be vertically movable as shown in FIG. 6*a*. Almost simultaneously with the pressing by the pressing tool 10, the pair of clamping pieces 7, 8 are upwardly bent at about 90° to erect on both sides of the low-melting-point metal piece 9 as shown in FIG. 6*b*. When the low-melting-point metal 9 has been clamped and fixed by the pair of bent clamping pieces 7, 8, the pressing tool 10 is upwardly evacuated, and then, as shown in FIG. 6*c*, the ends of the pair of clamping pieces 7, 8 are bent to clamp a top portion of the low-melting-point metal piece 9 by a clamping tool (not shown). Thus, the clamping and fixing operation for the low-melting-point metal piece 9 is completed.

By the way, in order to increase an adjusting range of the fusion characteristic of the fusible body 4, it is necessary that the size (amount) of the low-melting-point metal piece 9 is changeable in a larger range.

However, in the aforementioned fuse element 1, when an outer diameter D of the low-melting-point metal piece 9 to be clamped and fixed is smaller than the width W of the melting metal adding portion 6 of the fusible body 4 as shown in FIG. 7*a*, the low-melting-point metal piece 9 cannot be clamped by the pair of clamping pieces 7, 8 even if the pair of clamping pieces 7, 8 are bent upwardly at a predetermined angle, as shown in FIG. 7*b*. When the pressing tool 10 that has pressed the low-melting-point metal piece 9 up to this moment is evacuated in order to deform the end portions of the pair of clamping pieces 7, 8, the low-melting-point metal piece 9 drops from between the pair of clamping pieces 7, 8, and that causes the pair of clamping pieces 7, 8 clamping nothing therebetween, as shown in FIG. 7*c*.

Therefore, in the conventional fuse element 1 as shown in FIGS. 6*a* to 6*c*, the size (the outer diameter D) of the low-melting-point metal piece 9 is limited to a range at least larger than the width W of the fusing metal adding portion 6 of the fusible body 5. As a result, it can not increase the adjusting range of the fusion characteristic of the fusible body 4 so much.

SUMMARY OF THE INVENTION

The present invention has been made to overcome the above problems, and an object of the invention is to provide a fuse element in which the outer diameter of the low-melting-point metal piece that can be clamped and fixed onto the fusible body is not limited to a range larger than the width of the melting metal adding portion of the fusible body, so that the adjusting range of the fusion characteristic of the fusible body can be increased.

The above object has been achieved by a fuse element which includes a substantially beltlike fusible body for electrically connecting a pair of connecting terminal portions to each other, the connecting terminal portions connected to an electric circuit, a low-melting-point metal piece clamped and fixed onto a melting metal adding portion arranged on the fusible body in order to adjust a fusion characteristic of the fusible body, and a pair of clamping pieces formed to extend outward from both side edges of the melting metal adding portion of the fusible body for clamping and fixing the low-melting-point metal piece set on the melting metal adding portion from both sides of the low-melting-point metal piece, in which the pair of clamping pieces have projections for holding the low-melting-point metal piece in press contact with each other by projecting into a space defined by a width of the melting metal adding portion when the clamping pieces are upwardly bent from both sides of the melting metal adding portion.

The fuse element of the invention has the projections that hold both sides of the low-melting-point metal piece by projecting into the space defined by the width of the melting metal adding portion when the clamping pieces are upwardly bent from both sides of the melting metal adding portion. Therefore, even if the outer diameter of the low-melting-point metal piece is smaller than the width of the melting metal adding portion of the fusible body, the dropping of the low-melting-point metal piece from the melting metal adding portion can be blocked by the clamping force of the pair of clamping pieces, and further, the end portions of the clamping pieces are bent to clamp a top portion of the low-melting-point metal piece. As a result, the low-melting-point metal piece can be clamped and fixed onto the melting metal adding portion reliably.

BRIEF DESCRIPTION OF THE DRAWINGS

FIGS. 2*a* to 2*c* are diagrams showing a fuse element assembling process, in which FIG. 2*a* shows a condition before a low-melting-point metal piece is clamped; FIG. 2*b* shows a condition during a clamping operation; and FIG. 2*c* shows a condition in which the low-melting-point metal piece has been clamped;

FIGS. 6*a* to 6*c* are diagrams showing a conventional fuse element assembling process in the case where the outer dimension of the low-melting-point metal piece is larger than the width of a melting metal adding portion, in which FIG. 6*a* shows a condition before the low-melting-point metal piece is clamped; FIG. 6*b* shows a condition during a clamping operation; and FIG. 6*c* shows a condition in which the low-melting-point metal has been clamped; and FIGS. 7*a* to 7*c* are diagrams showing a conventional fuse element assembling process in the case where the outer dimension of the low-melting-point metal piece is smaller than the width of the melting metal adding portion, in which FIG. 7*a* shows a condition before the low-melting-point metal piece is clamped; FIG. 7*b* shows a condition during a clamping operation; and FIG. 7*c* shows a condition in which the low-melting-point metal has been clamped.

DETAILED DESCRIPTION OF THE PREFERRED EMBODIMENT

A preferred embodiment of a fuse element of the present invention will now be described in detail with reference to the accompanying drawings.

Figure 1:
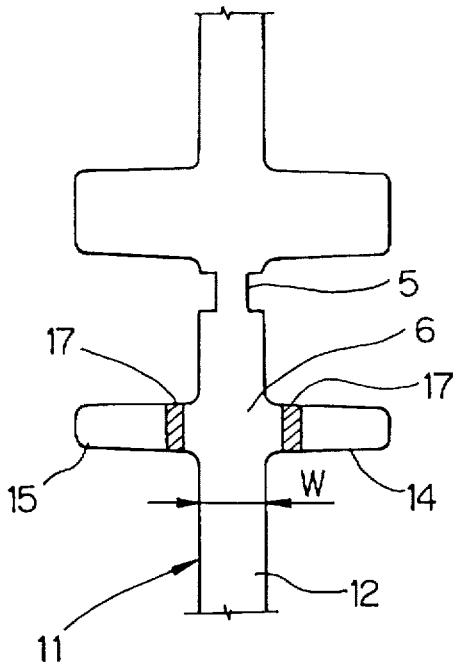
FIG. 1 is a plan view showing the main portion of a fuse element, which is an embodiment of the present invention, in developed form.
Figure 2A:
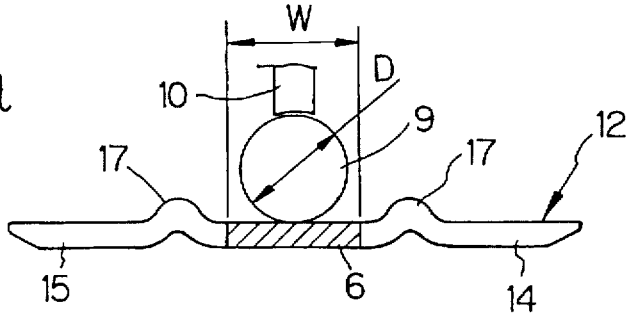
Figure 2B:
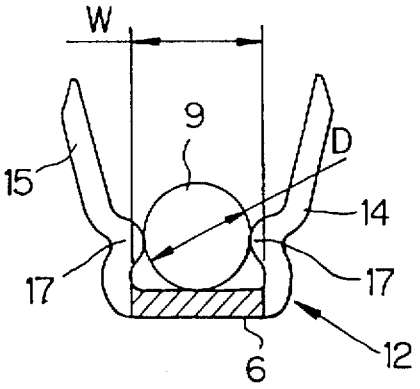
Figure 2C:
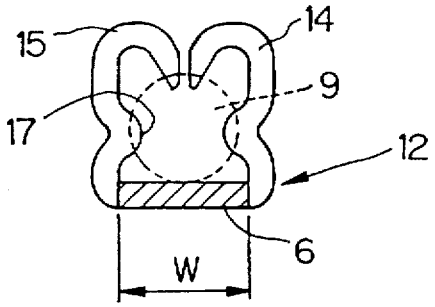

FIG. 1 and FIGS. 2*a* to 2*c* show a fuse element, which is the embodiment of the invention. FIG. 1 is a plan view showing the main portion of the fuse element in developed form; and FIGS. 2*a* to 2*c* are a diagram illustrative of a procedure for clamping a low-melting-point metal piece in a fuse element assembling process.

Figure 3:
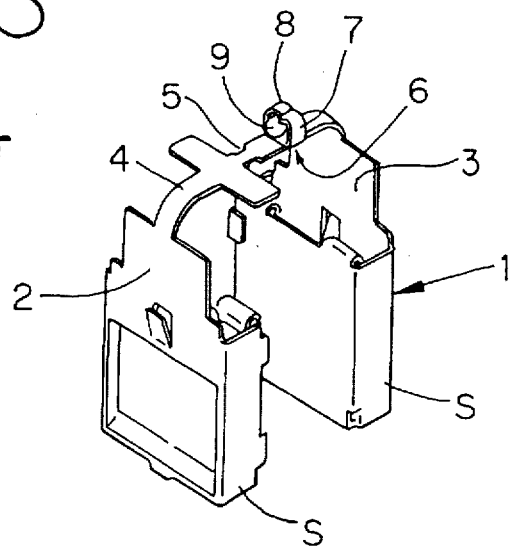
Fig. 3 PRIOR ART
FIG. 3 is a perspective view showing the appearance of a general structure of the fuse element.
Figure 4:
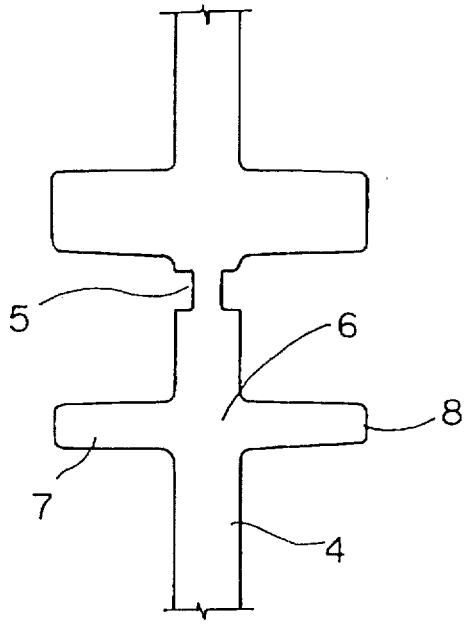
Fig. 4 PRIOR ART
FIG. 4 is a plan view showing a conventional fuse element in developed form.
Figure 5:
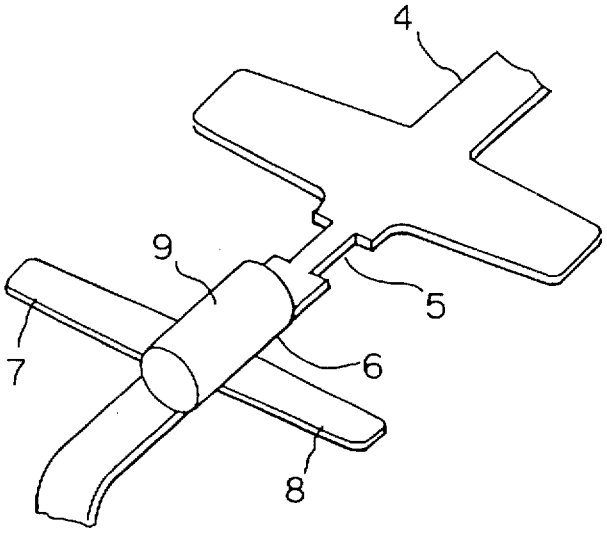
Fig. 5 PRIOR ART
FIG. 5 is a partially perspective view illustrative of how a low-melting-point metal piece of the conventional fuse element is disposed.
Figure 6A:
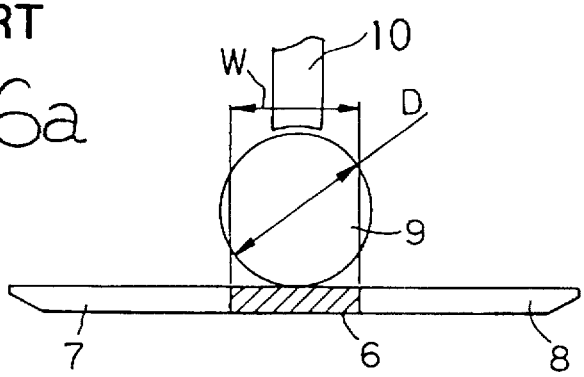
PRIOR ART Fig. 6a
Figure 6B:
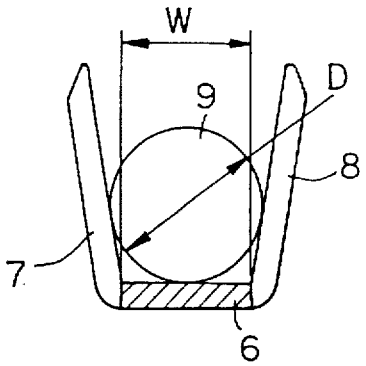
PRIOR ART Fig. 6b
Figure 6C:
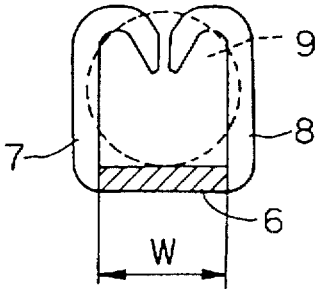
PRIOR ART Fig. 6c
Figure 7A:
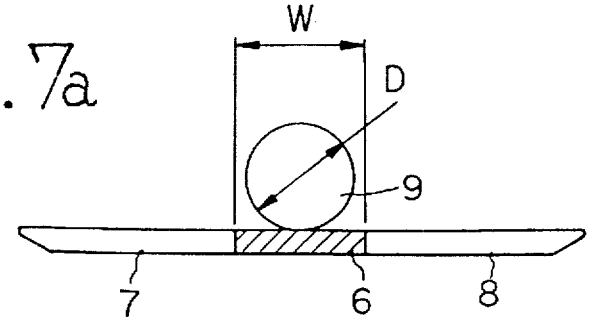
PRIOR ART Fig. 7a
Figure 7B:
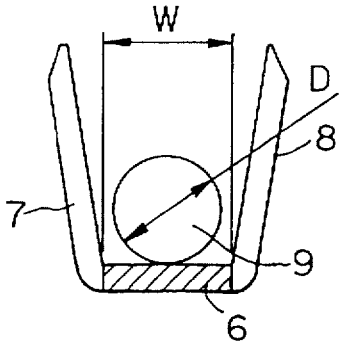
PRIOR ART Fig. 7b
Figure 7C:
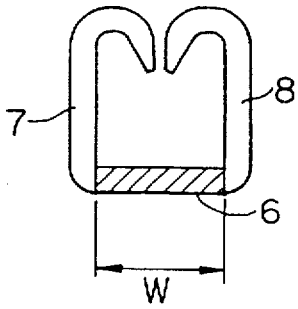
PRIOR ART Fig. 7c

As has already been shown in FIG. 3, a fuse element 11 is of a type that a pair of connecting terminal portions 2, 3 are integrally formed with a substantially belt-like fusible body 12 by press-forming a metal plate. The pair of connecting terminal portions 2, 3 are connected to an electric circuit, and the fusible body 12 electrically connects the pair of connecting terminal portions 2, 3 to each other. It may be noted that only the fusible body 12 that is continuous to the connecting terminal portions 2, 3 is shown in FIG. 1, with a description of the connecting terminal portions 2, 3 omitted because the structure of the connecting terminal portions 2, 3 is the same as that of the conventional example.

As shown in FIG. 1, the substantially belt-like fusible body 12 that electrically connects the pair of connecting terminal portions to each other and has a melting metal adding portion 6 arranged close to a fusible portion 5 whose width is so narrowed as to be easily fused based on a predetermined fusion characteristic. On both side edges of the melting metal adding portion 6 are clamping pieces 14, 15. The clamping pieces 14, 15 project in the width directions of the fusible body 12. The fuse element 11 is designed so that a low-melting-point metal piece 9, whose melting point is lower than that of the fusible body 12, is clamped and fixed onto the melting metal adding portion 6 by the pair of clamping pieces 14, 15 as shown in FIG. 2*c*.

The feature of the invention is that projections 17 are arranged on the pair of clamping pieces 14, 15, respectively as shown in FIG. 1 and FIGS. 2*a* to 2*c*. That is, the projections 17 hold the corresponding side portions of the low-melting-point metal piece 9 disposed on the melting metal adding portion 6 to project into a space defined by the width W of the melting metal adding portion 6 when the clamping pieces 14, 15 are bent at about 90° so as to erect on both sides of the melting metal adding portion 6. The projections 17 are formed by embossing each part of the clamping pieces 14, 15 in a press forming process.

The operation of clamping and fixing the low-melting-point metal piece 9 onto the melting metal adding portion 6 is performed by the same automatic clamping process as that in the conventional example.

Then, the assembling process for clamping and fixing the low-melting-point metal piece 9 onto the melting metal adding portion 6 will be described with reference to FIGS. 2*a* to 2*c*.

As shown in FIG. 1, the fusible body 12 is transferred to a predetermined position in the form of a flat metal blank in which the pair of clamping pieces 14, 15 extend coplanar with the fusible body 12 as an initial condition. When the fusible body 12 has been transferred to the predetermined position, the low-melting-point metal piece 9 is placed on the melting metal adding portion 6. Then, the low-melting-point metal piece 9 is kept intact on the melting metal adding portion 6, and is pressed and fixed onto the fusible body 12 by a pressing tool 10 that is arranged above the melting metal adding portion 6 so as to be vertically movable as shown in FIG. 2*a*. Almost simultaneously with the pressing operation by the pressing tool 10, the pair of clamping pieces 14, 15 are upwardly bent at about 90° to erect on both sides of the low-melting-point metal piece 9 as shown in FIG. 2*b*.

During the bending, the projections 17 on the clamping pieces 14, 15 project into a space defined by the width W of the melting metal adding portion 6, and as a result, even if the outer diameter D of the low-melting-point metal piece 9 on the melting metal adding portion 6 is smaller than the width W of the melting metal adding portion 6, the low-melting-point metal piece 9 is clamped between the projections 17 to be in press contact with these projections as shown in FIG. 2*b*. Thus, even if the pressing tool 10 has been evacuated upward, the low-melting-point metal piece 9 can be held by the clamping pieces 14, 15 without coming off from between the pair of clamping pieces 14, 15.

After the pressing tool 10 has been evacuated upward, the ends of the pair of clamping pieces 14, 15 are bent to clamp a top portion of the low-melting-point metal piece 9 by a clamping tool (not shown). In this case, the ends of the pair of clamping pieces 14, 15 clamp the low-melting-point metal piece 9 with the low-melting-point metal piece 9 blocked from coming off from the melting metal adding portion 6 by the clamping force of the pair of clamping pieces 14, 15 as shown in FIG. 2*c*. Therefore, the low-melting-point metal piece 9 can be clamped and fixed onto the melting metal adding portion 6 reliably.

That is, according to the fuse element 11 of the invention, the outer diameter D of the low-melting-point metal piece 9 that can be clamped and fixed onto the fusible body 12 is not limited by the width W of the melting metal adding portion 6 of the fusible body 12. Even if the low-melting-point metal piece 9 whose outer diameter D is smaller than the width W, the low-melting-point metal piece 9 can be clamped and fixed reliably, which in turn contributes to increasing the adjusting range of the fusion characteristic of the fusible body 12.

It may be noted that the position at which to arrange the projections 17 and the amount by which to project the projections 17 can be selected appropriately in accordance with a range of the outer diameter D of the low-melting-point metal piece 9 as to be selected to obtain a predetermined fusion characteristic of the fusible body 12.

It may further be noted that the projections 17 are not formed at the time of blanking the fusible body 12 by press forming, but can be formed to project from the fusible body 12 immediately before the clamping process is started in a clamping process line if the outer diameter D of the low-melting-point metal 9 is smaller than the width D of the melting metal adding portion 6, the clamping process line serving to clamp and fix the low-melting-point metal piece 9 onto the melting metal adding portion 6.

Further, while the pair of connecting terminal portions have the box-like electric contact portions as shown in FIG. 3 in the aforementioned embodiment, the connecting terminal portions may select any conventionally known form appropriately as long as the clamping pieces of the fusible body have projections that bring a low-melting-point metal piece into press contact with each other.

As described in the foregoing, according to the fuse element of the invention, the pair of clamping pieces arranged on both sides of a melting metal adding portion of a fusible body has projections that hold a low-melting-point metal piece disposed on the melting metal adding portion in press contact with each other at all times when the clamping pieces are upwardly bent from both sides of the melting metal adding portion. Therefore, the pair of clamping pieces can clamp the low-melting-point metal piece while blocking the low-melting-point metal piece from coming off therefrom even if the width of the melting metal adding portion is larger than the outer diameter of the low-melting-point metal piece. As a result, the low-melting-point metal piece can be clamped and fixed onto the melting metal adding portion reliably.

Hence, the outer diameter of the low-melting-point metal piece that can be clamped and fixed reliably onto the fusible body is not limited to the range of the width of the melting metal adding portion of the fusible body, which in turn contributes to increasing the adjusting range of the fusion characteristic of the fusible body.

What is claimed is:

1. A fuse element, comprising:

a fusible body for electrically connecting a pair of connecting terminal portions to each other, said connecting terminal portions connected to an electric circuit, said fusible body including:

a melting metal adding portion;

a low-melting-point metal piece having a curved surface fixed on said melting metal adding portion in order to adjust a fusion characteristic of said fusible body; and a pair of clamping pieces extended respectively from both side edges of said melting metal adding portion to clamp the low-melting-point metal piece from both sides, said clamping pieces having projections for holding said low-melting-point metal piece in press contact with each other by projecting into a space defined by a width of said melting metal adding portion when said clamping pieces are upwardly bent from the both sides of said melting metal adding portion.

2. The fuse element of claim 1, wherein end portions of said clamping pieces clamp a top portion of said low-melting-point metal piece.

3. The fuse element of claim 1, wherein when an outer diameter of said low-melting-point metal piece is smaller than the width of said melting metal adding portion, said projections of said clamping pieces prevents said low-melting-point metal piece coming off from said melting metal adding portion by projecting into the space defined by the width of said melting metal adding portion and holding both sides of said low-melting-point metal piece.

* * * * *